United States Patent [19]

Jacobs

[11] Patent Number: 5,076,017

[45] Date of Patent: Dec. 31, 1991

[54] SAFETY DOOR ASSEMBLY INCLUDING SAFETY HINGE

[76] Inventor: Edward Jacobs, 25342 W. Gardner Rd., Wauconda, Ill. 60084

[21] Appl. No.: 635,261

[22] Filed: Dec. 28, 1990

[51] Int. Cl.[5] ..... E05D 11/00

[52] U.S. Cl. ..... 49/383; 16/392; 49/395

[58] Field of Search ..... 49/383, 362, 395; 16/392, 389, 391, 390

[56] References Cited

U.S. PATENT DOCUMENTS

| | | | |
|---|---|---|---|
| 2,101,465 | 12/1937 | Beers | 49/383 X |
| 2,887,193 | 5/1959 | Sitler | 16/392 X |
| 3,827,183 | 8/1974 | Zimmerman et al. | 49/383 |
| 4,173,099 | 11/1979 | Robb | 49/383 X |
| 4,283,882 | 8/1981 | Hubbard et al. | 49/395 X |
| 4,850,143 | 7/1989 | Crooimans | 49/383 |

FOREIGN PATENT DOCUMENTS

| | | | |
|---|---|---|---|
| 241491 | 12/1911 | Fed. Rep. of Germany | 16/391 |
| 2431592 | 3/1980 | France | 16/389 |

*Primary Examiner*—Philip C. Kannan

*Attorney, Agent, or Firm*—Kajane McManus

[57] ABSTRACT

The safety hinge is proposed for use to eliminate pinching of fingers in the area between a door frame and the hinge edge of a door panel. The hinge comprises interlocking hinge sections each including mounting flange, an arm extending perpendicularly from said flange and terminating in a pivot element by means of which the hinge sections join together to form the hinge. The safety hinge is used in a safety door assembly which further includes a resilient end cap secured to the swing edge of the door panel and structure for latching the door in a closed position thereof as well as structure for keeping the door panel from swinging through the door frame.

14 Claims, 2 Drawing Sheets

SAFETY DOOR ASSEMBLY INCLUDING SAFETY HINGE

BACKGROUND OF THE INVENTION

The present invention pertains to a safety door assembly and safety hinge used therein. More particularly the invention relates to a door assembly wherein fingers cannot be pinched by either lateral edge of the door panel thereof.

PRIOR ART

Heretofore various structures have been proposed for use on various types of door structures for eliminating the crushing force capable of being applied by the hinged and non-hinged edge of a door.

For example, doors on public transportation vehicles are formed with rubberized lateral non hinged surfaces so that crushing of a body part does not take place if a commuter is accidentally caught in a closing door.

The Seaman U.S. Pat. No. 2,184,259 discloses a door which eliminates the danger of children pinching their fingers between the rear edge of a door and the door frame by providing on the rear edge of the door a bulbous in cross section non compressible member which seats within a convex seat for same on the door frame.

Also, the Wheeler U.S. Pat. No. 3,141,204 discloses a door frame construction including a transversely movable pressure plate which is yieldingly mounted therein so that, when pressure is applied thereagainst, such as by a finger or hand caught between the edge of the door and plate, it moves inwardly to avoid injuring the finger or hand.

Further the Zimmerman et al U.S. Pat. No. 3,827,183 discloses a center hung pivot door assembly having a narrow jamb projection member attached to the pivot jamb of the door frame along substantially the entire length thereof and projecting outwardly from the pivot jamb into the door frame opening. The space between the projection and the pivot stile is less than the thickness of a human finger so no pinching of same can occur.

The safety door assembly of the present invention is proposed for use as an interior door. At times, for the sake of privacy, it is required that the door be lockable. Because of the unique lateral door edges of the safety door, a vertical locking element is required. Many vertical locking structures have been proposed for use.

One example is found in the Hagenbock U.S. Pat. No. 2,189,712 which discloses a vertical locking means for use on a wing of a revolving door. The locking means are key actuated to move a bar of metal upwardly into a receptacle for same built into the ceiling of the door.

Also, the Scott U.S. Pat. No. 3,086,383 discloses a two way locking device for locking a door at its top and bottom. The locking device is key actuated from either side of the door.

As will be described in greater detail hereinafter the safety door assembly of the present invention includes structure at the swing end thereof which eliminates pinching of fingers. Also, for the sake of privacy, the door may be locked. Finally, the door assembly includes unique hinge structure which also eliminates pinching of fingers along the hinge edge of the door.

SUMMARY OF THE INVENTION

According to the invention there is provided a safety door hinge which includes a pivot which is substantially spaced away from a door panel and door frame to which it is attached and which allows arcuate swinging of the door to slightly greater than 90° from a closed position thereof.

Further according to the invention there is provided a safety door hinge defined above as well as a resilient end cap engaged on the lateral swing edge of the door panel. A vertical latching bar which is door knob actuated is further provided for securing the door panel in a closed position thereof. The door panel is kept from swinging through the door frame by the provision of a stop member on the upper horizontal frame member and engages against the swing edge of the door panel.

To secure the hinge end opening between the door panel and the door frame from intrusion by fingers, structure is provided to close off the opening in the areas not filled by the safety hinges.

DESCRIPTION OF THE PREFERRED EMBODIMENT

Figure 1:
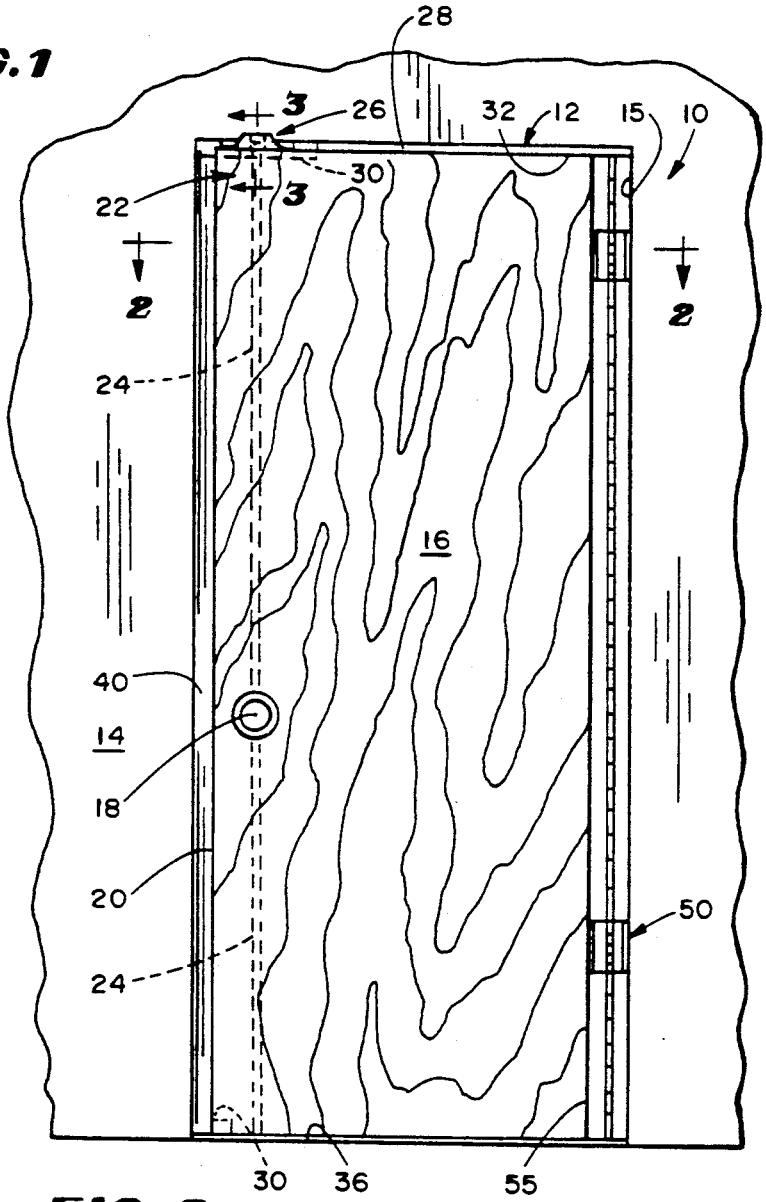
FIG. 1 shows the safety door assembly of the present invention mounted in a wall.

Referring now to the drawings in greater detail there is illustrated in FIG. 1 the safety door assembly 10 of the present invention.

The door assembly 10 is shown mounted to a door frame 12 which is engaged to a wall 14, framing a door opening 15 therein.

The door assembly 10 is proposed primarily for use as an interior closure but this is not to be construed as limiting.

The door assembly 10 includes a door panel 16, preferably of the hollow core type, making the panel 16 light weight and includes a doorknob 18 which is inset relative to a lateral swing edge 20 of the door panel 16.

Figure 3:
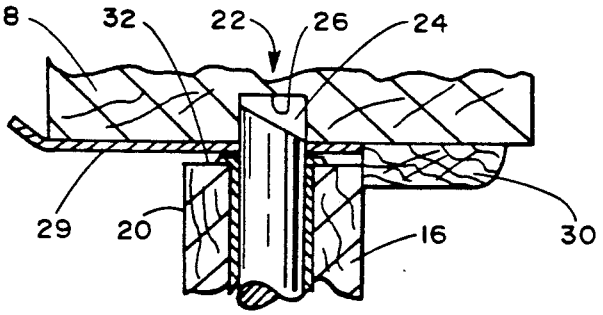
FIG. 3 is a cross sectional view through a portion of the safety door assembly incorporating latching/locking structure therefor, and is taken along line 3—3 of FIG. 1.
Figure 4:
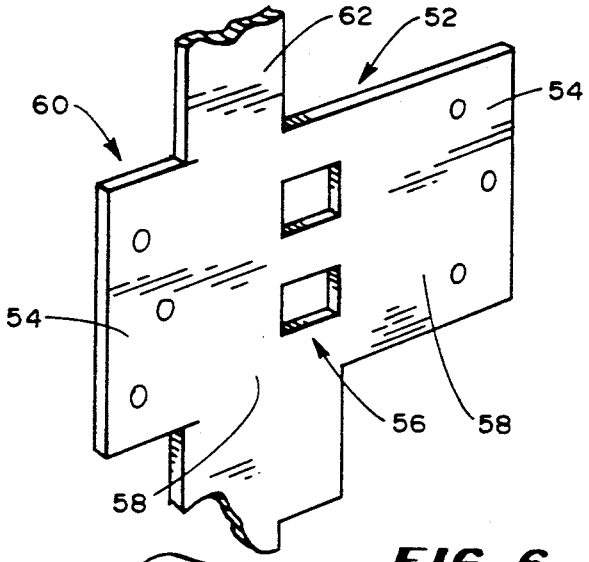
FIG. 4 is a perspective view of a portion of a sheet of material as it is cut out for use in creating the safety hinge of the present invention.

The doorknob 18 operates in known manner, to control a latching/locking mechanism 22 including a vertical bar latch 24 extending upwardly from the doorknob 18 which engages within a receptacle 26 for same in a top horizontal frame member 28 of the door frame 12. The vertical bar latch 24 is shown in this embodiment to be circular in cross section but this is not to be construed as limiting. Also, if desired, a striker plate 29 may be provided, as best shown in FIG. 3.

The top horizontal frame member 28 may also include a stop member 30 depending downwardly therefrom for engaging against upper end 32 of the panel 16, to keep same from swinging through the door frame 12.

Under certain circumstances, where an excessive pressure may be applied against a lower portion of the door panel 16, in the area beneath the doorknob 18, such as, for example, where small children are present, the door assembly 10 may incorporate a second stop member 30 and a second vertical bar latch 24 which may engage within threshold 36 of the door frame 12.

Figure 2:
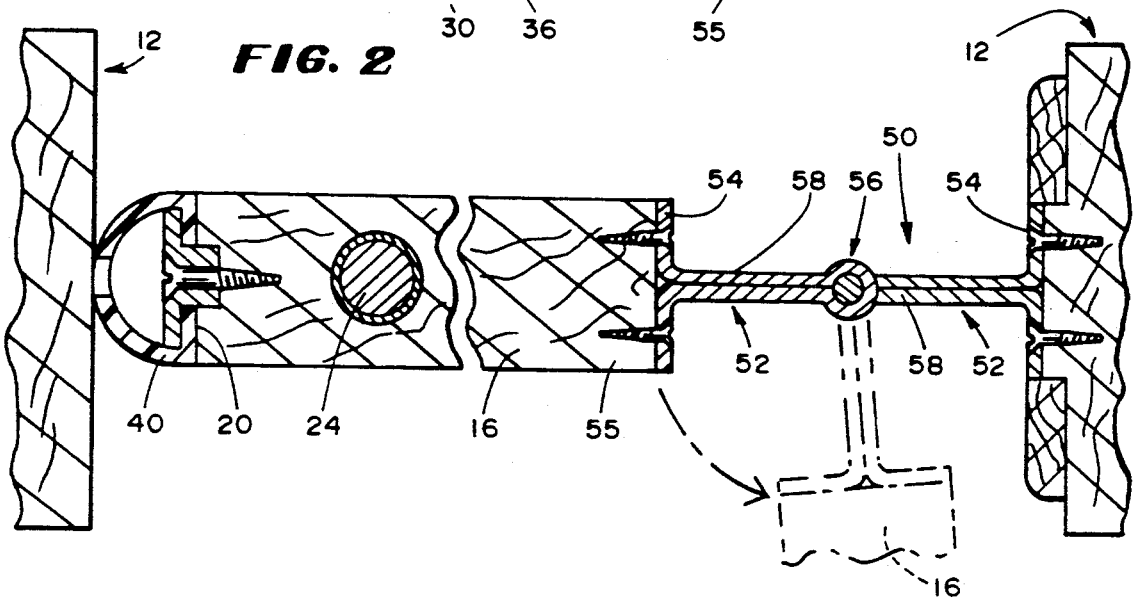
FIG. 2 is a cross sectional view through the door assembly taken along line 2—2 of FIG. 1.

The door panel 16 is seen to be significantly narrower than dimension of the door frame 12. The reason for this is best illustrated in FIG. 2.

As shown therein, the door panel 16 includes an end cap element 40 along the length of the swing edge 20 thereof. This end cap element 40 is a semicircular in cross section is made of a soft pliable material such as rubber. The end cap element 40 has a radial dimension slightly greater than the thickness of a persons finger or hand, providing a swing edge 20 to the door panel 16 which is incapable of pinching. Also, because the end cap element 40 is resilient, it creates a good air seal against the door frame 12 by molding itself thereagainst.

The unique hinge element 50 of the door assembly 10 also creates a need for the narrowed door panel 16.

In this respect, the hinge element 50 is seen to comprise two interlocking hinge sections 52, each of which includes a mounting flange 54 for securement to either a hinge end 55 of the door panel 16 or door frame 12 and a pivot element 56 which is spaced a significant distance from the mounting flange 54 by an arm member 58 which extends perpendicularly outwardly of the mounting flange 54.

Figure 5:
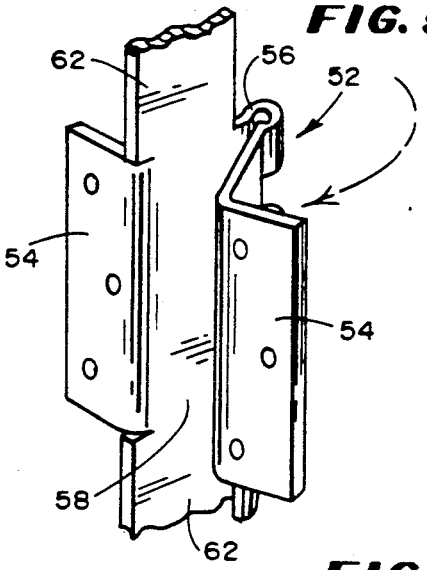
FIG. 5 is a perspective view of the sheet of material of FIG. 4 showing same being folded into a portion of a hinge.
Figure 6:
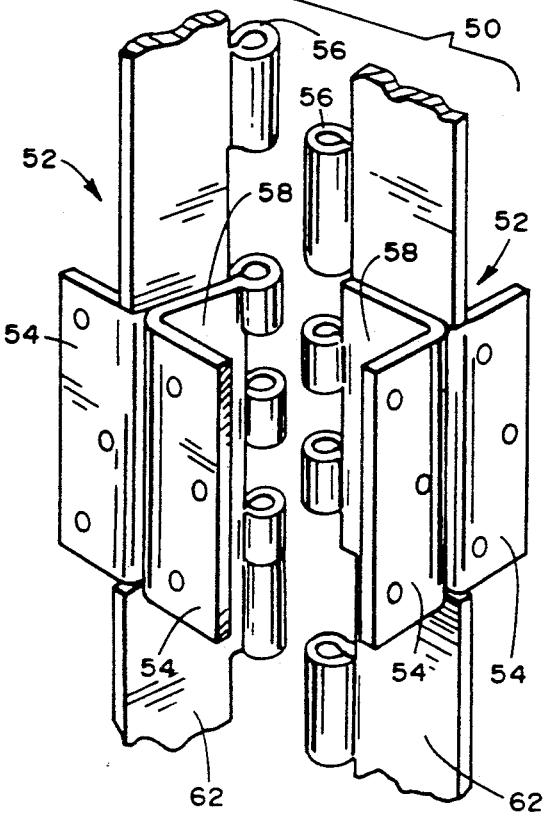
FIG. 6 is a perspective view of two hinge portions about to be engaged to one another.
Figure 7:
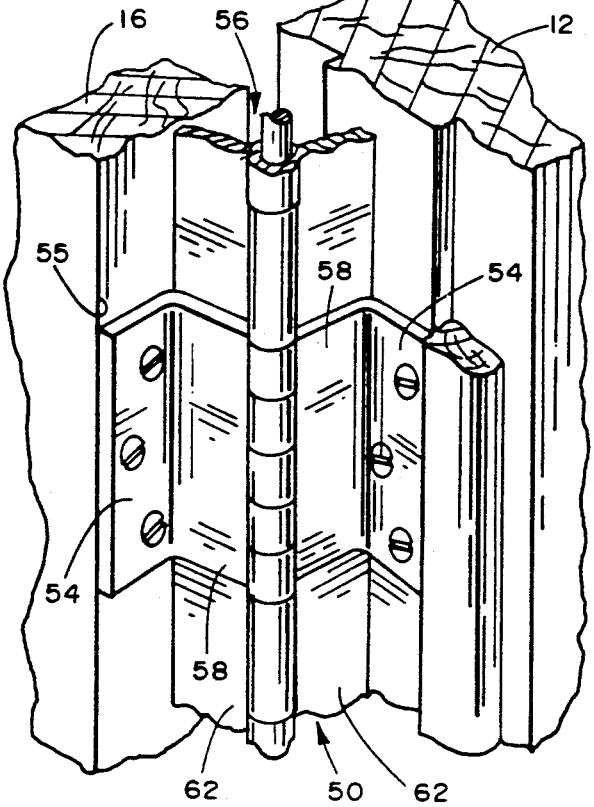
FIG. 7 is a perspective view of the hinge portions of FIG. 6 joined to one another, with one hinge portion also being engaged to a door frame and the other hinge portion joined to the hinge end of the safety door panel.

As best illustrated in FIGS. 4–7, each hinge section 52 is formed from a sheet of material 60, such as metal, which has been stamped out to have a predetermined shape and predetermined cut out areas. This sheet of material is then folded as shown in FIG. 5 to form the hinge sections 52, the pivot elements 56 of which fit interlocking together as shown in FIG. 6 and 7.

As illustrated, the arm member 58 is formed of a double thickness of the material 60, which is folded over upon itself while the pivot element 56 is formed as a circular structure along the fold in the material 60. At the flange 54 end of each hinge section 52, the double thickness of the material is folded back toward its respective source to form the single thickness mounting flange 54. Also, in the embodiment shown, one thickness of each arm member 58 may be continued to create a skirt 62 extending vertically between adjacent hinge forming sections 52 which are spaced from one another along the length of the sheet of material 60 to form two or three spaced apart hinge elements 50 along the length of the door panel 16.

When the hinge sections 52 are joined to one another as shown in FIG. 7, the extended skirts 62 of the arm members 58 at the pivot element 56 form a barrier across the open areas between the door panel 16 and door frame 12, not allowing for entry of fingers therebetween.

Also, the pivot elements 56 are formed in a manner to allow the door panel 16 to only swing slightly more than 90° arcuately (FIG. 2) from its closed position, eliminating potential pinching between the door panel 16 and door frame 12 along the hinge end 55 of the door panel 16.

In the drawing, the pivot element 56 is shown to extend the entire length of the door panel 16, Although this is preferred, several other options are available.

For example, the hinge elements 50 can be formed separate from one another, with the area between door panel 16 and door frame 12 being covered with a plastic sleeve along the hinge end 55 of the door panel 16. Further, the area between the hinge elements 50 could incorporate a skirting 62 therebetween made of a stiff but flexible material other than metal which could be engaged between the spaced apart hinge elements 50 and extended along the length of the door frame 12.

As described above, the safety door assembly 10 and safety hinge element 50 have a number of advantages, some of which have been described above and others of which are inherent in the invention. Also modifications can be proposed to the structures without departing from the teachings of the present invention. Accordingly the scope of the invention is only to be limited as necessitated by the accompanying claims.

I claim:

1. A safety hinge for use on a door, the hinge including interlocking hinge sections each comprising:

a flanged end used to create a mounting surface;

an arm extending perpendicularly outwardly from the flanged end; and a pivot element formed as a circular extension of the arm and by means of which the hinge sections are engaged to one another to form said hinge;

each hinge section being folded from a single sheet of material blanked to create the circular pivot member along the fold and having the arm extending therefrom, the arm being of a double thickness and being folded back upon itself by 90° to create the mounting flange for the hinge section.

2. The hinge of claim 1 wherein the hinge sections interconnect by means of interlocking areas blanked into the pivot member of each hinge section.

3. The hinge of claim 2 wherein the blanked areas on one hinge section alternate with the blanked areas on the opposite hinge section.

4. The hinge of claim 3 wherein the hinge section are joined to one another by a pin extended through the interconnected pivot members.

5. A safety door for eliminating the pinching capability of the door panel of the assembly along the lateral edges thereof, said assembly including:

a door panel significantly narrower than the opening within a door frame of the assembly and having a lateral swing edge and a lateral hinge edge;

a resilient end cap engaged over and along the entire length of the lateral swing edge of the door panel; and a plurality of safety hinges along said lateral hinge edge of said door panel, joining said door panel to said door frame, each safety hinge comprising a pivot center which is spaced from both the door panel and door frame, each door hinge being limited to swing through an arc approximately 90° and having means for covering the area between the door panel and door frame along the hinge edge of the door assembly.

6. The door assembly of claim 5 wherein said end cap is of a radial dimension slightly greater than the thickness of a finger.

7. The door assembly of claim 6 wherein said end cap is slightly compressed when said door is closed within said door frame.

8. The door assembly of claim 7 wherein said hinge pivot is approximately centrally located within the space between the hinge end of the door panel and the adjacent frame portion.

9. The door assembly of claim 8 wherein said hinge rotates only slightly more than 90° from a fully extended position thereof.

10. The door assembly of claim 9 further including a door knob and means engaged to said door knob for operating a vertical latch element to engage and disengage an end of said latch element extending upwardly outwardly of a top surface of said door panel into a receptacle for same cut into a corresponding area of said door frame.

11. The door assembly of claim 10 further including an upper stop member depending from said door frame in a manner to abut against the swing end of said door panel.

12. The door assembly of claim 12 further including a second stop member extending upwardly from a threshold portion of said door frame.

13. The door assembly of claim 12 further including a second latch means extending downwardly from said door knob, said latch engaging within a receptacle for same in said threshold.

14. A safety door assembly for eliminating the pinching capability thereof along the lateral edges thereof, said assembly including:

a door panel significantly narrower than the opening within a door frame of the assembly and having a lateral swing edge and a lateral hinge edge;

a semicircular in cross section end cap engaged over and along the entire length of the lateral swing edge of the door panel;

a plurality of safety hinges attached to and between said hinge edge of said door panel and said door frame, each safety hinge comprising a pivot which is set away from the door and door frame, which swings through an arc of approximately 90° and includes means for covering the area between the door panel and door frame between the hinges and above and below the topmost and bottommost hinge, respectively;

means for latching said door panel in a closed position thereof; and means for keeping said door panel from swinging through said frame.

* * * * *